US009085891B2

(12) United States Patent
Horton, III

(10) Patent No.: US 9,085,891 B2
(45) Date of Patent: Jul. 21, 2015

(54) STUD ELEVATOR

(71) Applicant: John R Horton, III, Fort Worth, TX (US)

(72) Inventor: John R Horton, III, Fort Worth, TX (US)

( * ) Notice: Subject to any disclaimer, the term of this patent is extended or adjusted under 35 U.S.C. 154(b) by 0 days.

(21) Appl. No.: 13/902,823

(22) Filed: May 26, 2013

(65) Prior Publication Data

US 2014/0345217 A1 Nov. 27, 2014

(51) Int. Cl.

| | |
|---|---|
| ***E04B 2/56*** | (2006.01) |
| ***E04B 1/64*** | (2006.01) |
| *E04B 2/70* | (2006.01) |

(52) U.S. Cl.

CPC *E04B 1/644* (2013.01); *E04B 2/707* (2013.01)

(58) Field of Classification Search

CPC ..... E04B 1/644; E04B 2/707; E04B 1/7046; E04B 2/706

USPC ..... 52/293.1, 293.3, 169.5, 481.2, 481.1, 52/302.1, 94–95, 716.1, 716.2, 58, 60–62, 52/292, 146, 633, 652.1, 783.1, 783.11, 52/783.18, 783.19, 784.14, 68, 261, 52/264–266, 289, 220.8, 209, 274, 276; 248/346.01, 346.4

See application file for complete search history.

(56) References Cited

U.S. PATENT DOCUMENTS

| | | | | |
|---|---|---|---|---|
| 3,934,805 | A * | 1/1976 | Elaschuk | 248/346.4 |
| 4,265,064 | A * | 5/1981 | Parezo | 52/302.3 |
| 4,399,972 | A * | 8/1983 | McCulloch | 248/346.4 |
| 5,052,580 | A * | 10/1991 | Khoury | 220/505 |
| 5,316,420 | A * | 5/1994 | Watanabe et al. | 409/190 |
| 5,394,665 | A * | 3/1995 | Johnson | 52/241 |
| 5,626,284 | A * | 5/1997 | Franzen | 229/120.36 |
| 5,660,119 | A * | 8/1997 | Perkins | 108/51.3 |
| 5,787,659 | A * | 8/1998 | Rinehart | 52/209 |
| 6,216,405 | B1 * | 4/2001 | Smith | 52/235 |
| 6,883,279 | B2 * | 4/2005 | Fukuro et al. | 52/209 |
| 7,669,369 | B2 * | 3/2010 | Henry et al. | 49/471 |
| 7,669,384 | B2 * | 3/2010 | Kaida et al. | 52/790.1 |
| 7,954,280 | B2 * | 6/2011 | Andras | 52/169.5 |
| 8,074,416 | B2 * | 12/2011 | Andrews | 52/241 |
| 2003/0177699 | A1 * | 9/2003 | Fukuro et al. | 49/408 |
| 2006/0026911 | A1 * | 2/2006 | Sutton | 52/169.5 |
| 2007/0051863 | A1 * | 3/2007 | Froeschner et al. | 248/346.01 |
| 2009/0235608 | A1 * | 9/2009 | Kosny et al. | 52/652.1 |
| 2011/0045916 | A1 * | 2/2011 | Casimaty et al. | 472/92 |
| 2012/0222215 | A1 * | 9/2012 | Chang et al. | 5/114 |

* cited by examiner

*Primary Examiner* — Beth Stephan

(74) *Attorney, Agent, or Firm* — James E. Walton; Brian E. Harris

(57) ABSTRACT

A stud support base device to support a stud for a wall of a dwelling may include a front wall, a back wall being opposed to the front wall, a pair of opposing side walls to connect the back wall and the front wall, and a lattice of interconnecting support walls to support the front wall, the back wall and the pair of opposing side walls. The front wall may include an aperture which extends to the support surface for the stud support base device.

5 Claims, 4 Drawing Sheets

STUD ELEVATOR

FIELD OF THE INVENTION

The present invention relates to a stud support base device and more particularly to a stud support base device that allows water and other fluids to drain from the stud support base device.

BACKGROUND

Water seeping into a home or other dwelling presents a problem in that the water may cause studs which may be made from wood to deteriorate along with other building material. In addition, the water which may seep into a dwelling may cause mold to grow on the building material which can result in serious consequences to the inhabitants of the dwelling. Once the water has entered the construction material of the dwelling, the water may remain trapped due to inadequate ventilation and a path for the water to flow from the construction material.

SUMMARY

A stud support base device to support a stud for a wall of a dwelling may include a front wall, a back wall being opposed to the front wall, a pair of opposing side walls to connect the back wall and the front wall, and a lattice of interconnecting support walls to support the front wall, the back wall and the pair of opposing side walls. The front wall may include an aperture which extends to the support surface for the stud support base device.

The lattice of interconnecting support walls may include a first angled wall formed a first acute angle with respect to the front wall.

The lattice of inner connecting support walls may include a second angled wall formed with a second to the angle with respect to the front wall.

The first angled may be substantially 45°.

The second angled may be substantially 135°.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
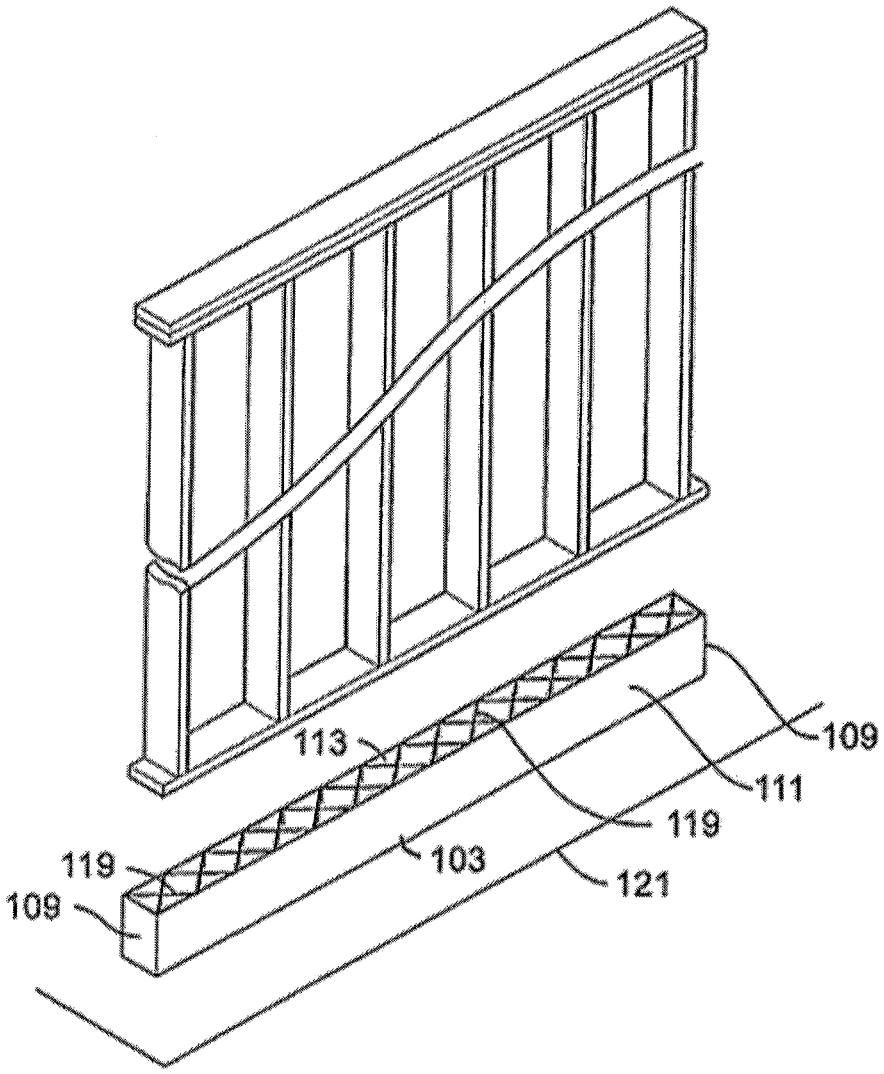
FIG. 1 illustrates a perspective view of the stud support base device of the present invention.

The stud support base device 103 as illustrated in FIG. 1 may include a front wall 111 which may be opposed to a back wall 113 and may be connected to a pair of opposing side walls 109, the back wall 113 may be connected to the side walls 109, and the pair of side walls 109 may be connected to the front wall 111 and the back wall 113.

Figure 2:
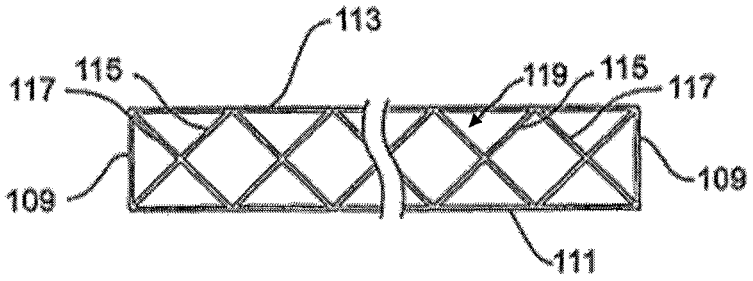
FIG. 2 illustrates a top view of the stud support base device of the present invention.

FIGS. 1 and 2 additionally illustrate a lattice 119 of intersecting support walls which may include a first angled wall 115 and a second angled wall 117. The first angled wall 115 may extend from and be connected to the front wall 111 and to the back wall 113 and may be positioned at an acute angle which may be 45° with respect to the front wall 111 and the back wall 113, and the first angled wall 115 may be continuous and may be substantially the same height as the front wall 111 and the back wall 113. The front wall 111 and the back wall 113 may extend beyond (over) the lattice 119.

The second angled wall 117 may extend from and connect to the front wall 111 or to the back wall 113 and may be positioned at an acute angle which may be 45° with respect to the front wall and the back wall 113 and the second angled wall 117 may be a discontinuous and may be connected to the first angled wall 115 at a substantially perpendicular angle (90°).

The second angled wall 117 may extend from and connect to the first angled wall 115 and may be positioned at a substantially perpendicular angle which may be 90° with respect to the first angled wall 115 and the second angled wall 117 may be discontinuous and may be connected to the first angled wall 115 at a substantially perpendicular angle (90°).

The front wall 111, the back wall 113, the opposing side walls 109, the first angled wall 115 and the second angled wall 117 may be formed from metal, wood, plastic, a combination of these materials or other materials. In addition, these walls may have a an aperture 114, which may extend through the front wall 111, the back wall 113, the opposing side walls 109 the first angled wall 115 and the second angled wall 117 and may extend through a bottom surface of these walls in order to cooperate with a support surface 121 which may support the above-mentioned walls 111, 113, 109, 115, 117 in order to provide a path along the support surface 121 for the fluid such as water to drain from the stud support base device 103. Advantageously, the stud support base device 103 may be formed from the material which may not absorb the fluid such as water so that the stud support base device 103 is not degraded by the fluid such as water.

The stud support base device 103 as illustrated in FIG. 2 may include a front wall 111 which may be opposed to a back wall 113 and may be connected to a pair of opposing side walls 109, the back wall 113 may be connected to the side walls 109, and the pair of side walls 109 may be connected to the front wall 111 and the back wall 113.

FIG. 2 additionally illustrates a lattice 119 of intersecting support walls which may include a first angled wall 115 and a second angled wall 117. The first angled wall 115 may extend from and be connected to the front wall 111 and to the back wall 113 and may be positioned at an acute angle which may be 45° with respect to the front wall 111 and the back wall 113, and the first angled wall 115 may be continuous and may be substantially the same height as the front wall 111 and the back wall 113.

The second angled wall 117 may extend from and connect to the front wall 111 or to the back wall 113 and may be positioned at an acute angle which may be 45° with respect to the front wall 111 and the back wall 113 and the second angled wall 117 may be a discontinuous and may be connected to the first angled wall 115 at a substantially perpendicular angle (90°).

The second angled wall 117 may extend from and connect to the first angled wall 115 and may be positioned at a substantially perpendicular angle which may be 90° with respect to the first angled wall 115 and the second angled wall 117 may be a discontinuous and may be connected to the first angled wall 115 at a substantially perpendicular angle (90°).

The front wall 111, the back wall 113, the opposing side walls 109, the first angled wall 115 and the second angled wall 117 may be formed from substantially solid metal, wood, plastic, a combination of these materials or other materials. In addition, these walls may have an aperture 114 which may extend through the front wall 111, the back wall 113, the opposing side walls 109 the first angled wall 115 and the second angled wall 117 and may extend through a bottom surface of these walls in order to cooperate with a support surface 121 which may support the above-mentioned walls 111, 113, 109, 115, 117 in order to provide a path along the support surface 121 for the fluid such as water to drain from the stud support base device 103. Advantageously, the stud support base device 103 may be formed from material which does not absorb fluid such as water so that the stud support base device 103 is not degraded by fluid such as water.

Figure 3:
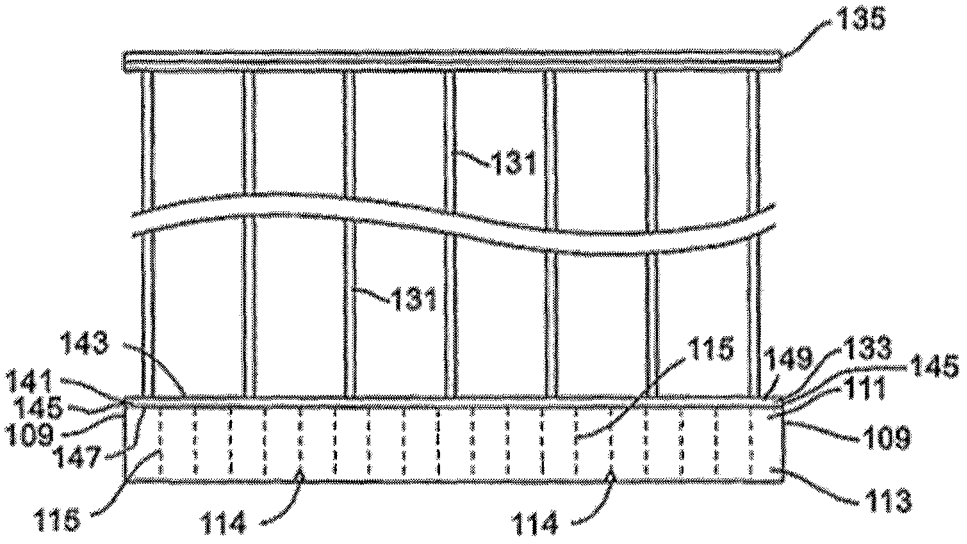
FIG. 3 illustrates a side view of the stud support base device being used in a stud system.

The stud support base device 103 as illustrated in FIG. 3 may include a front wall 111 which may be opposed to a back wall 113 and may be connected to a pair of opposing side walls 109, the back wall 113 may be connected to the side walls 109, and the pair of side walls 109 may be connected to the front wall 111 and the back wall 103.

FIG. 3 additionally illustrates a lattice 119 of intersecting support walls which may include a first angled wall 115 and a second angled wall 117. The first angled wall 115 may extend from and be connected to the front wall 111 and to the back wall 113 and may be positioned at an acute angle which may be 45° with respect to the front wall 111 and the back wall 113, and the first angled wall 115 may be continuous and may be substantially the same height as the front wall 111 and the back wall 113.

The second angled wall 117 may extend from and connect to the front wall 111 or to the back wall 113 and may be positioned at an acute angle which may be 45° with respect to the front wall and the back wall 113 and the second angled wall 117 may be a discontinuous and may be connected to the first angled wall 115 at a substantially perpendicular angle (90°).

The second angled wall 117 may extend from and connect to the first angled wall 115 and may be positioned at a substantially perpendicular angle which may be 90° with respect to the first angled wall 115 and the second angled wall 117 may be a discontinuous and may be connected to the first angled wall 115 at a substantially perpendicular angle (90°).

The front wall 111, the back wall 113, the opposing side walls 109, the first angled wall 115 and the second angled wall 117 may be formed from metal, wood, plastic, a combination of these materials or other materials. In addition, these walls may have a aperture 119 an aperture 114 which may extend through the front wall 111, the back wall 113, the opposing side walls 109 the first angled wall 115 and the second angled wall 117 and may extend through a bottom surface of these walls in order to cooperate with a support surface 121 which may support the above-mentioned walls 111, 113, 109, 115, 117 in order to provide a path along the support surface 121 for fluid such as water to drain from the stud support base device 103. Advantageously, the stud support base device 103 may be formed from the material which does not absorb fluid such as water so that the stud support base device 103 is not degraded by fluid such as water.

FIG. 3 additionally illustrates the stud base 133 which may include a substantially solid rectangle and which may include a stud base front surface 141 which may be connected to the stud base top surface 143, a pair of opposing stud base side surfaces 145 and a stud base bottom surface 147 to cooperate with the top surface of the front wall 111, the top surface of the back wall 113, the top surface of the opposing side walls 109, the top surface of the first angled wall 115 and the top surface of the second angled wall 117 to support the stud base 133.

FIG. 3 additionally illustrates that a multitude of studs 131 may be connected to the stud base 133 and may be connected to the stud support top member 135. The stud base front surface 141 may be opposed to a stud base back surface 149 which may be connected to the stud base top surface 143, the a pair of opposing stud base side surfaces 145 and the stud base bottom surface 147.

FIG. 3 illustrates the stud support member 135 which may include a substantially solid rectangle and which may include a stud support member front surface 151 which may be connected to the stud support member top surface 143, a pair of opposing stud support member side surfaces 145 and a stud support member bottom surface 147. The stud support member front surface 141 may be opposed to a stud support member back surface 149 which may be connected to the stud support member top surface 143, the a pair of opposing stud support member side surfaces 145 and the stud support member bottom surface 147.

Figure 4:
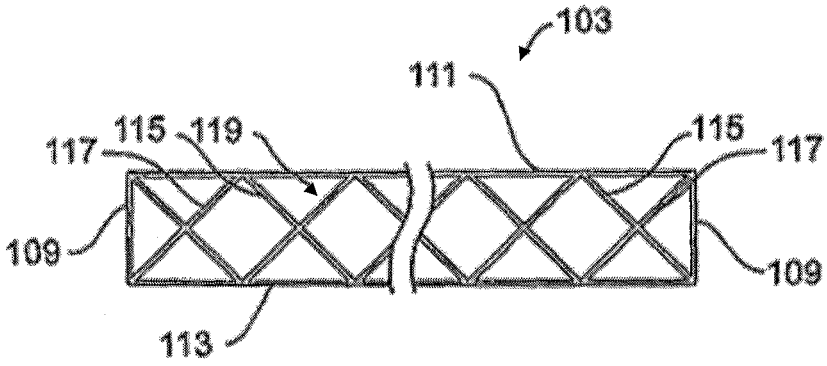
FIG. 4 illustrates a bottom view of the stud support base device of the present invention.

FIG. 4 illustrates a bottom view of the stud support base device 103 of the present invention, The stud support base device 103 as illustrated in FIG. 4 may include a front wall 111 which may be opposed to a back wall 113 and may be connected to a pair of opposing side walls 109, the back wall 113 may be connected to the side walls 109, and the pair of side walls 109 may be connected to the front wall 111 and the back wall 103.

FIG. 4 additionally illustrates a lattice 119 of intersecting support walls which may include a first angled wall 115 and a second angled wall 117. The first angled wall 115 may extend from and be connected to the front wall 111 and to the back wall 113 and may be positioned at an acute angle which may be 45° with respect to the front wall 111 and the back wall 113, and the first angled wall 115 may be continuous and may be substantially the same height as the front wall 111 and the back wall 113.

The second angled wall 117 may extend from and connect to the front wall 111 or to the back wall 113 and may be positioned at an acute angle which may be 45° with respect to the front wall and the back wall 113 and the second angled wall 117 may be a discontinuous and may be connected to the first angled wall 115 at a substantially perpendicular angle (90°).

The second angled wall 117 may extend from and connect to the first angled wall 115 and may be positioned at a substantially perpendicular angle which may be 90° with respect to the first angled wall 115 and the second angled wall 117 may be a discontinuous and may be connected to the first angled wall 115 at a substantially perpendicular angle (90°).

The front wall 111, the back wall 113, the opposing side walls 109, the first angled wall 115 and the second angled wall 117 may be formed from metal, wood, plastic, a combination of these materials or other materials. In addition, these walls may have a aperture 119 which may extend through the front wall 111, the back wall 113, the opposing side walls 119, the first angled wall 115 and the second angled wall 117 and may extend through a bottom surface of these walls in order to cooperate with a support surface 121 which may support the above-mentioned walls 111, 113, 119, 115, 117 in order to provide a path along the support surface 121 for the fluid such as water to drain from the stud support base device 103. Advantageously, the stud support base device 103 may be formed from the material which may not absorb the fluid such as water so that the stud support base device 13 is not degraded by the fluid such as water.

Figure 5:
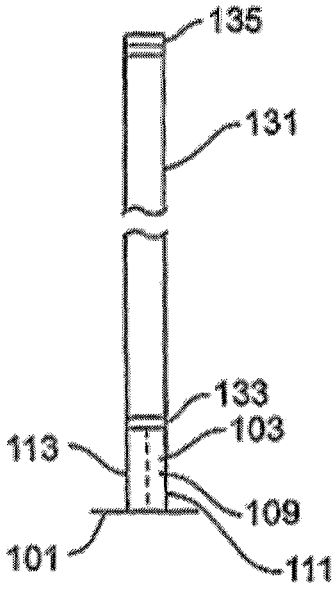
FIG. 5 illustrates an end view of the stud support base device being used in the stud system.

FIG. 5 illustrates a side view of the stud support base device 103 which may be positioned on a support surface 101 which may be a concrete pad, and the stud support base device 103 may be connected to the stud base 133 which may support the multitude of studs 131 which may be connected to the stud support top member 135.

FIG. 5 additionally illustrates front wall 111, the back wall 113 and a sidewall 109 of the stud support base device 103.

Figure 6:
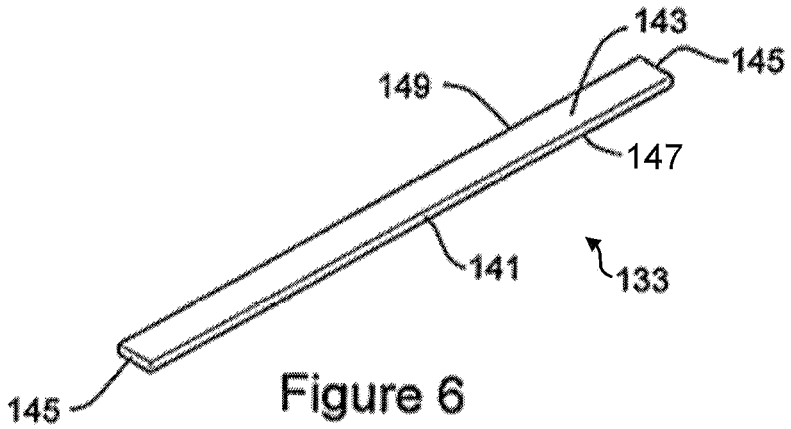
FIG. 6 illustrates a perspective view of the stud base bottom member of the present invention.

FIG. 6 illustrates a perspective view of the stud base 133 which may include a substantially solid rectangle and which may include a stud base front surface 141 which may be connected to the stud base top surface 143, a pair of opposing stud base side surfaces 145 and a stud base bottom surface 147. The stud base front surface 141 may be opposed to a stud base back surface 149 which may be connected to the stud base top surface 143, the a pair of opposing stud base side surfaces 145 and the stud base bottom surface 147.

Figure 7:
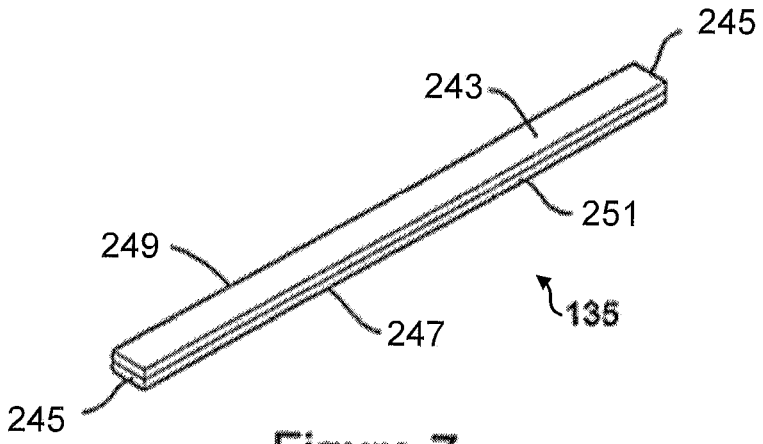
FIG. 7 illustrates a perspective view of the stud support top member of the present invention.

FIG. 7 illustrates a perspective view of the stud support member 135 which may include a substantially solid rectangle and which may include a stud support member front surface 251 which may be connected to the stud support member top surface 243, a pair of opposing stud support member side surfaces 245 and a stud support member bottom surface 247. The stud support member front surface 251 may be opposed to a stud support member back surface 249 which may be connected to the stud support member top surface 243, the pair of opposing stud support member side surfaces 245 and the stud support member bottom surface 247.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A structure comprising:

a support surface;

a stud; and a stud support device between the support surface and the stud, the stud support device comprising:

a front wall;

a back wall opposing the front wall;

a pair of opposing side walls connecting the back wall and the front wall;

a lattice of interconnecting support walls supporting the front wall, the back wall and the pair of opposing side walls, the lattice being configured for supporting the stud;

wherein the front wall includes an aperture which extends to the support surface.

2. The structure of claim 1, wherein the lattice of interconnecting support walls includes a first angled wall formed at a first acute angle with respect to the front wall.

3. The structure of claim 2, wherein the lattice of interconnecting support walls includes a second angled wall formed at a second angle with respect to the front wall.

4. The structure of claim 2, wherein the first angle is substantially 45°.

5. The structure of claim 2, wherein the second angle is substantially 135°.

* * * * *